US012111094B2

(12) United States Patent
Jackson

(10) Patent No.: US 12,111,094 B2
(45) Date of Patent: Oct. 8, 2024

(54) REFRIGERATED DEVICE WITH DOOR OPEN SENSOR FAULT IDENTIFICATION

(71) Applicant: ILLINOIS TOOL WORKS INC., Glenview, IL (US)

(72) Inventor: Steven T. Jackson, Fort Worth, TX (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 114 days.

(21) Appl. No.: 17/479,450

(22) Filed: Sep. 20, 2021

(65) Prior Publication Data

US 2022/0099357 A1 Mar. 31, 2022

Related U.S. Application Data

(60) Provisional application No. 63/084,214, filed on Sep. 28, 2020.

(51) Int. Cl.
*F25D 21/14* (2006.01)
*F25D 29/00* (2006.01)

(52) U.S. Cl.
CPC ..... *F25D 21/14* (2013.01); *F25D 29/00* (2013.01); *F25D 2321/143* (2013.01); *F25D 2321/1441* (2013.01); *F25D 2400/04* (2013.01); *F25D 2700/02* (2013.01); *F25D 2700/12* (2013.01)

(58) Field of Classification Search
CPC .... F25D 21/06; F25D 21/004; F25D 2700/10; F25D 2321/1413
See application file for complete search history.

(56) References Cited

U.S. PATENT DOCUMENTS

| | | | | |
|---|---|---|---|---|
| 3,707,851 | A | 1/1973 | McAshan, Jr. | |
| 3,736,765 | A | 6/1973 | O'Dell | |
| 6,427,454 | B1 * | 8/2002 | West | G05D 22/02 62/93 |
| 10,323,875 | B2 | 6/2019 | Sanders | |
| 2016/0047587 | A1 * | 2/2016 | Sasaki | F25D 17/042 348/82 |
| 2019/0257567 | A1 * | 8/2019 | Sanders | F25D 21/04 |
| 2021/0048239 | A1 * | 2/2021 | Muko | F25D 11/003 |

FOREIGN PATENT DOCUMENTS

WO WO-2019193648 A1 * 10/2019 ..... F25D 21/14

* cited by examiner

*Primary Examiner* — Nelson J Nieves
*Assistant Examiner* — Meraj A Shaikh
(74) *Attorney, Agent, or Firm* — THOMPSON HINE LLP

(57) ABSTRACT

A refrigerated device includes a compartment including an access door. A refrigeration circuit for cooling the compartment includes an evaporator coil with an associated evaporator fan and a condenser with an associated condenser fan. A temperature sensor is provided for indicating a compartment temperature within the compartment. A controller is configured to: (i) monitor the compartment temperature in order to approximate a number of door openings, (ii) compare the approximated number of door openings to a data point and (iii) take a control action based upon a certain result of the comparison.

17 Claims, 4 Drawing Sheets

REFRIGERATED DEVICE WITH DOOR OPEN SENSOR FAULT IDENTIFICATION

TECHNICAL FIELD

This application relates generally to refrigerated devices, such as refrigerator units and freezer units and, more specifically, to a refrigerated device with a control system that is able to approximate a number of door openings of the device.

BACKGROUND

Refrigerators are used in numerous settings, such as in a commercial setting or in a domestic setting. Typically, refrigerators are used to store and maintain food products by providing a cooled environment into which the products can be stored. Refrigeration systems typically include a refrigerated cabinet into which the food products are placed and a refrigeration assembly for cooling the air and products in the refrigerated cabinet. The refrigeration assembly often includes an evaporator assembly and a condenser assembly, each forming a portion of a refrigerant loop or circuit. A refrigerant is used to carry heat from air within the refrigerated cabinet to the ambient environment surrounding the refrigerated cabinet. The refrigerant absorbs heat in the evaporator assembly and then rejects the absorbed heat in the condenser assembly.

Condensate on the evaporator coils may freeze, and such frost may accumulate on evaporator coils of the evaporator assembly, which decreases the efficiency of the refrigeration assembly. Defrosting cycles are typically utilized to remove the frost from the evaporator coils. Once frost has been removed from the evaporator coils, the defrost water or condensate may be transferred to a condensate pan where it may accumulate and be evaporated to ambient environment.

Certain operating environments, specifically those with higher dew points and larger numbers of door openings to the cabinet, lead to more condensate and more frost build-up on the evaporator coils. It is known from U.S. patent Ser. No. 10/323,875 that door openings affect the amount of frost build-up, and therefore a door open sensor can aid in the determination of when to initiate a defrost cycle. If the door open sensor is not operating properly, operation of the refrigerated device can be adversely affected.

SUMMARY

In one aspect, a refrigerated device includes a compartment including an access door. A refrigeration circuit for cooling the compartment includes an evaporator coil with an associated evaporator fan and a condenser with an associated condenser fan. A temperature sensor is provided for indicating a compartment temperature within the compartment. A controller is configured to: (i) monitor the compartment temperature in order to approximate a number of door openings, (ii) compare the approximated number of door openings to a data point and (iii) take a control action based upon a certain result of the comparison.

In another aspect, a refrigerated device includes a compartment including an access door, a refrigeration circuit for cooling the compartment, and a temperature sensor for indicating a compartment temperature within the compartment. A controller is configured to monitor the compartment temperature in order to approximate a number of access door openings. One or more control actions of the refrigerated device may be implemented based, at least in part, upon the approximated number of door openings.

In a further aspect, a method is provided for controlling a refrigerated device that includes a compartment including an access door, a refrigeration circuit for cooling the compartment, and a temperature sensor for indicating a compartment temperature within the compartment. The method involves: monitoring the compartment temperature; and evaluating the compartment temperature over time in order to approximate a number of access door openings.

The details of one or more embodiments are set forth in the accompanying drawings and the description below. Other features, objects, and advantages will be apparent from the description and drawings, and from the claims.

DETAILED DESCRIPTION

Figure 1:
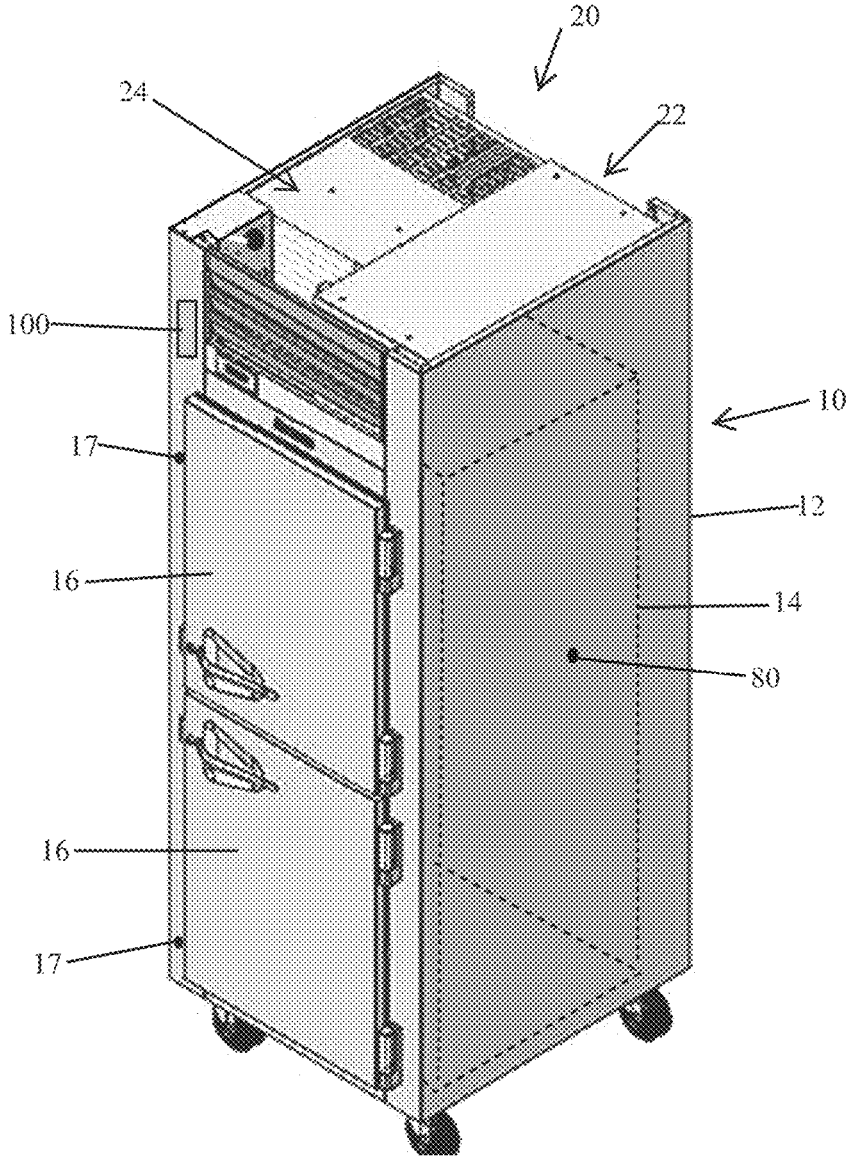
FIG. 1 shows a refrigerated device.
Figure 2:
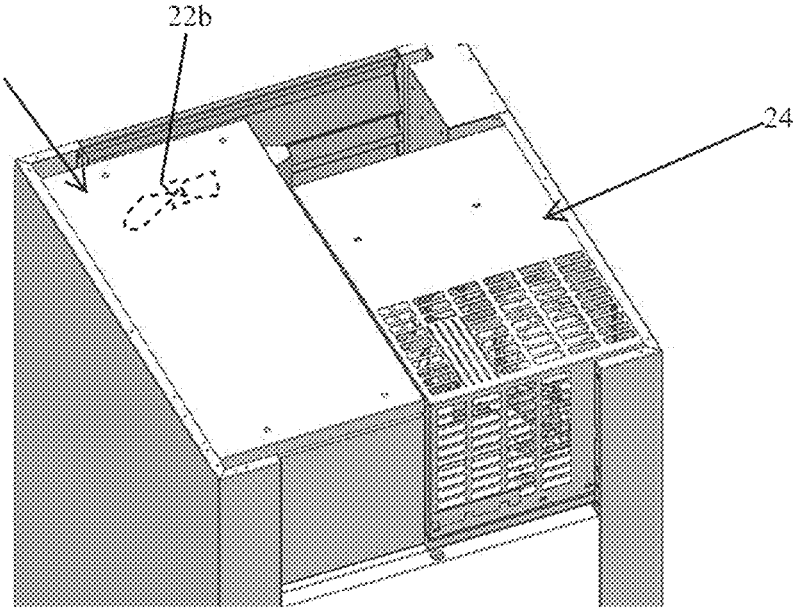
FIGS. 2 and 3 show an evaporator unit and condenser unit atop the refrigerated device.
Figure 3:
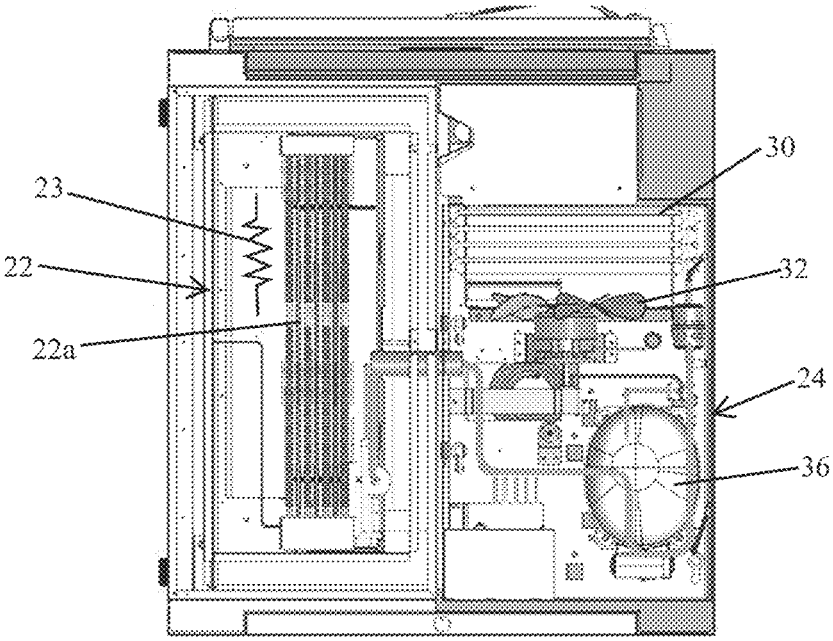
Figure 4:
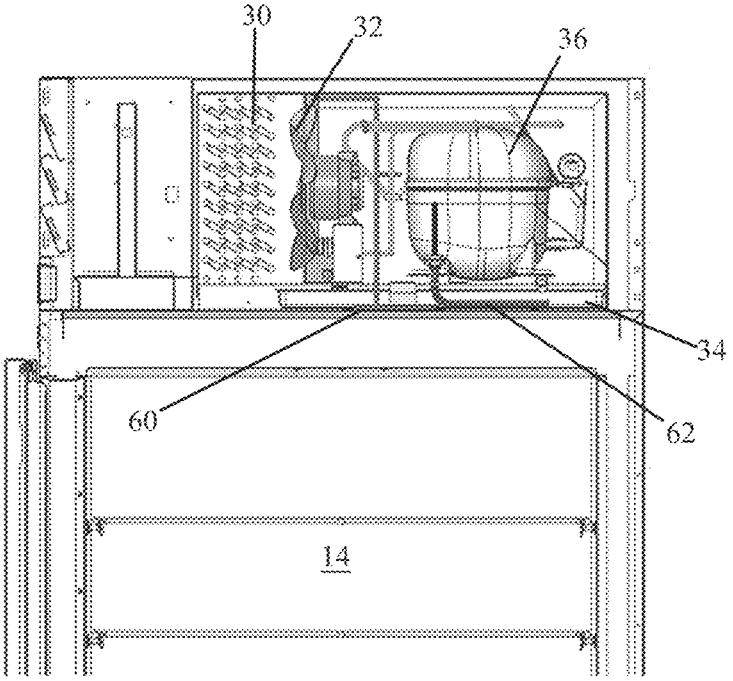
FIGS. 4 and 5 show the condenser unit of the device.

U.S. Pat. No. 10,323,875 forms a part of this disclosure and is incorporated herein by reference.

FIGS. 1-5 show a refrigerated device 10 (refrigerator and/or freezer) with a cabinet 12 defining one or more internal compartments 14 that are cooled and accessible via one or more doors 16. Door open sensors 17 are also shown, but could be located elsewhere (e.g., around the door or at the hinge(s)).

Figure 5:
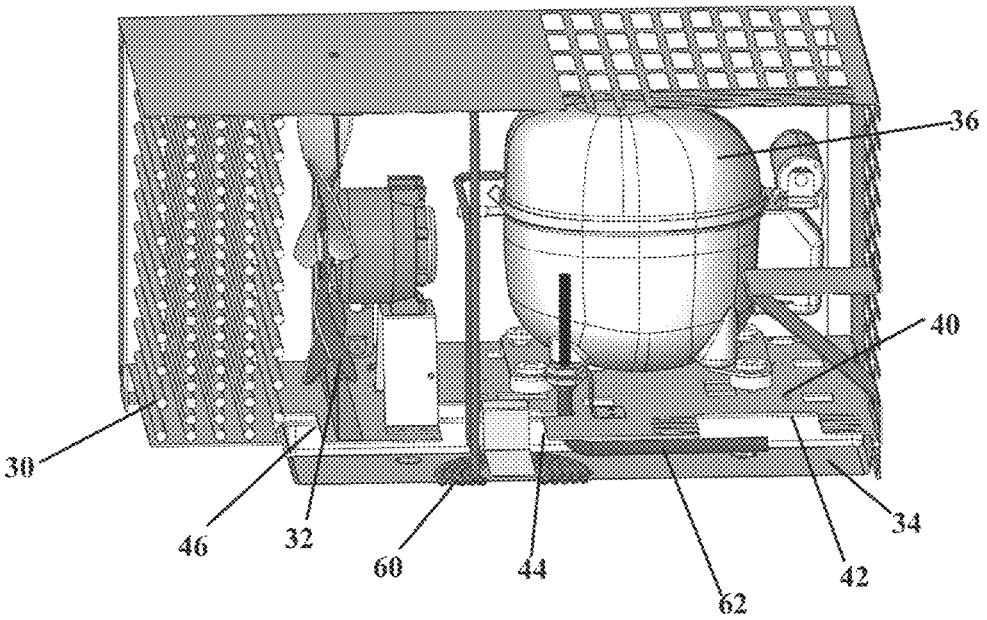

The refrigeration system 20 of the device is located at the top of the cabinet 12 and includes an evaporator unit or assembly 22 and a condenser unit or assembly 24. The evaporator unit 22 includes an evaporator coil 22*a* and an air circulation fan 22*b*, shown schematically, and a path for condensate to run to the condensate pan of the condenser unit 24. A heater 23, shown schematically, for defrosting of the evaporator coil, is also provided. The condenser unit 24 includes the condenser coil 30, fan 32 and condensate pan 34, as well as the compressor 36. As best seen in FIG. 5, the floor 40 of the condenser unit includes three openings 42, 44 and 46 to the condensate pan 34.

A hot gas loop 60 is provided in the condensate pan for condensate heating, and a supplemental electric heating element 62 is also provided in the condensate pan in order to further enhance the heating of the condensate and increase the evaporation rate.

The heating element 23 and the heating element 62 can be controlled based upon a number of door openings. The device includes a controller 100 configured for controlling the various operations of the device, including cooling operations and defrost operations (involving activation of the heat sources 23 and 62). As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other components, or a combination of some or all of the above, that carries out the control functions of the device or the control functions of any component thereof.

The controller 100 is configured to selectively activate the heat sources 23 and 62. For example, the controller 100 is configured to, based upon the output of the door sensors 17, (i) count the number of door openings and use that number (the door sensor-based door open count) for control of one or more components or operations of the device, such as the heaters 23 and/or 62 and/or (ii) evaluate the duration of one or more door open conditions for controlling one or more components or operations of the device, such as the heaters 23 and/or 62.

Figure 6:
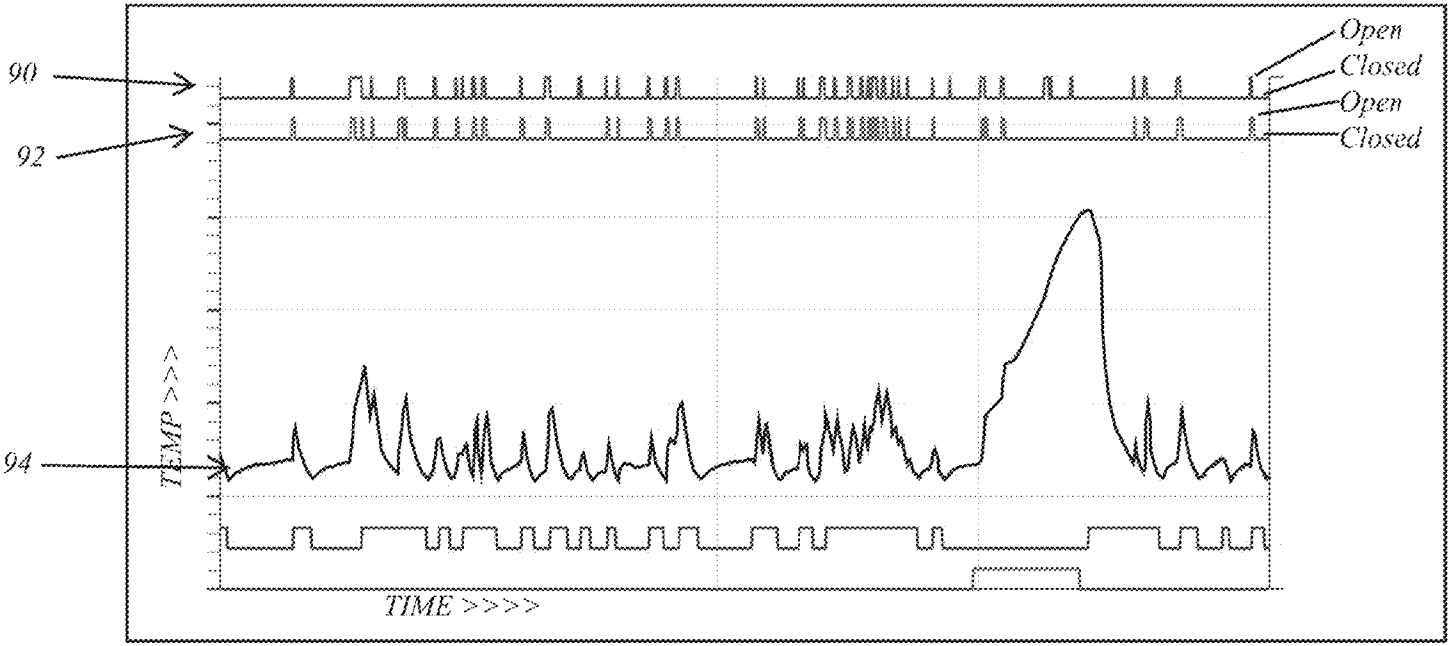
FIG. 6 shows a graph of door openings and compartment temperature.

The controller 100 is also configured to approximate the number of door openings utilizing secondary data. In one example, the refrigerated compartment 14 includes a temperature sensor 80 located in the compartment 14 for indicating the temperature within the compartment 14. This sensor data is used to control the refrigeration system 20 for maintaining desired temperature conditions within the compartment 14. The temperature sensor data can also be evaluated to approximate the number of door openings, because the compartment temperature will rise when the door 16 is opened. FIG. 6 shows a graph of actual door openings 90, approximated door openings 92 and the compartment temperature 94. As seen, the detected compartment temperature rises fairly sharply during and shortly following an actual door opening. In one implementation, this sharp rise is detectable by calculating the first derivative of the compartment temperature.

Thus, the controller 100 is configured to repeatedly calculate the first derivative of the compartment temperature indicated by the sensor 80. If the first derivative of the indicated compartment temperature rises above a set threshold, the controller 100 assumes that the door was opened and increments the approximated door open count. A material discrepancy between the actual door sensor-based door open count and the approximated door open count suggests that the door open sensor 17 is not functioning properly. For example, if the sensor-based door open count is low (or zero), and the approximated door open count is high, then the door sensor 17 is likely not working properly or at all. Thus, the controller 100 is configured to compare the approximated door open count to a data point, which may be the door sensor-based door open count, and take some control action if a discrepancy between the two is higher than a threshold number. Another technique to perform this comparison is to determine a ratio of the door sensor-based door open count to the approximated door open count (i.e., sensor count/approximated count), and take some control action if the calculated ratio is less than an acceptable threshold or outside an acceptable range. In one example, the controller 100 changes the active logic of device 10 operation so that, rather than defrosting based upon the door open sensor-based count, the controller 100 defaults to an assumed worst-case scenario in which the defrost interval is more frequent.

Both the door sensor-based door open count and the approximated door open count are reset to zero after an evaporator defrost operation. In another control action example, a duration for running the condensate pan heater 62 can also be set to a set level (longer duration) based upon the door sensor fault determination.

To determine that a problem exists, there should be a minimum number of predicted door openings. There are times of the day, for example, overnight, where there is no activity of the refrigerated device 10. The minimum is used to prevent false positives. In high use, the temperature may rise significantly and the first derivative is higher than the set threshold. In this case, the prediction algorithm may calculate multiple door openings where a single door open event actually occurred. While there can be both false positives and false negatives, the ratio of the actual door sensor-based door openings to the predicted/approximated door openings is used to determine if a door sensor/switch has failed. In a simple case, an actual door sensor-based door open count of zero and a predicted door open count greater than the PredictedCountMin (for example, 10) indicates a problem with the door sensor. With a sensor that is failing intermittently, a ratio of actual door sensor-based door openings to predicted/approximated door openings, i.e., sensor actual/predicted ("RatioActPre"), should be in the range $0.5<\text{RatioActPre}<1.5$.

It is to be clearly understood that the above description is intended by way of illustration and example only, is not intended to be taken by way of limitation, and that other changes and modifications are possible.

What is claimed is:

1. A refrigerated device, comprising:

a compartment including an access door;

a refrigeration circuit for cooling the compartment, the refrigeration circuit including an evaporator coil with an associated evaporator fan and a condenser with an associated condenser fan;

a door sensor positioned for identifying an open condition of the access door;

a temperature sensor for indicating a compartment temperature within the compartment;

a controller configured to: (i) monitor the compartment temperature indicated by the temperature sensor, (ii) repeatedly calculate a first derivative of the compartment temperature and increment an expected door open count if the first derivative of the compartment temperature rises, (iii) monitor the door sensor to maintain a door sensor based door open count, (iv) compare the expected door open count to the door sensor based door open count, (v) determine that the door open sensor is malfunctioning based on a discrepancy between the door sensor based door open count and the expected door open count, and (vi) take a control action based upon the discrepancy.

2. The refrigerated device of claim 1, wherein the controller is configured to take the control action if the discrepancy is above a set threshold.

3. The refrigerated device of claim 1, wherein the discrepancy is the expected door open count being greater than the door sensor-based door open count by a set number.

4. The refrigerated device of claim 3, wherein the control action is changing a logic used for establishing when to initiate a defrost operation.

5. The refrigerated device of claim 3, wherein the control action is setting a duration for running a condensate pan heater.

6. The refrigerated device of claim 1, wherein the controller is configured to compare the expected door open count to the door sensor based door open count by (i) determining a difference between the expected door open count and the door sensor based door open count or (ii) determining a ratio between the expected door open count and the door sensor based door open count.

7. A refrigerated device, comprising:

a compartment including an access door;

a refrigeration circuit for cooling the compartment;

a door sensor positioned for identifying an open condition of the access door;

a controller configured to: (i) monitor the compartment temperature indicated by a temperature sensor, (ii)

repeatedly calculate a first derivative of the compartment temperature and increment an expected door open count if the first derivative of the compartment temperature rises above a set threshold, (iii) monitor the door sensor to maintain a door sensor based door open count, (iv) compare the expected door open count to the door sensor based door open count, (v) determine that the door open sensor is malfunctioning based on a discrepancy between the door sensor based door open count and the expected door open count, and (vi) take a control action based upon the discrepancy.

8. The refrigerated device of claim 1, wherein the controller is configured to increment the expected door open count if the first derivative of the compartment temperature rises above a set threshold.

9. The refrigerated device of claim 7, wherein the controller is further configured to compare the expected door open count to a data point.

10. The refrigerated device of claim 9, wherein the controller is further configured to take the control action for the refrigerated device based upon a certain result of the comparison.

11. The refrigerated device of claim 9, wherein the controller is configured to compare the expected door open count to the data point by (i) determining a difference between the expected door open count and the data point or (ii) determining a ratio between the expected door open count and the data point.

12. The refrigerated device of claim 8, wherein the controller is configured such that the expected door open count is reset to zero after a defrosting operation of the refrigeration circuit.

13. A method of controlling a refrigerated device that includes a compartment including an access door, a refrigeration circuit for cooling the compartment, a door sensor positioned for identifying an open condition of the access door, a temperature sensor for indicating a compartment temperature within the compartment, and a controller, the method comprising:

monitoring the compartment temperature;

repeatedly calculating a first derivative of the compartment temperature and incrementing an expected door open count if the first derivative of the compartment temperature rises above a set threshold;

monitoring the door sensor to maintain a door sensor based door open count;

comparing the expected door open count to the door sensor based door open count;

determining that the door open sensor is malfunctioning based on a discrepancy between the door sensor based door open count and the expected door open count; and taking a control action based upon the discrepancy.

14. The method of claim 13, further comprising:

implementing the control action for the refrigerated device based, at least in part, upon the expected door open count.

15. The method of claim 13, further comprising, comparing the expected door open count to the data point by (i) determining a difference between the expected door open count and the data point or (ii) determining a ratio between the expected door open count and the data point.

16. The method of claim 14, wherein based upon a certain result of the comparing step, initiating the control action of the refrigerated device.

17. The refrigerated device of claim 7, wherein based upon a certain result of the comparing step, the control action of the refrigerated device is initiated.

* * * * *